US005835062A

United States Patent [19]

Heckaman et al.

[11] Patent Number: 5,835,062

[45] Date of Patent: Nov. 10, 1998

[54] FLAT PANEL-CONFIGURED ELECTRONICALLY STEERABLE PHASED ARRAY ANTENNA HAVING SPATIALLY DISTRIBUTED ARRAY OF FANNED DIPOLE SUB-ARRAYS CONTROLLED BY TRIODE-CONFIGURED FIELD EMISSION CONTROL DEVICES

[75] Inventors: Douglas E. Heckaman, Indialantic, Fla.; David B. Kanaly, Blairsville, Ga.

[73] Assignee: Harris Corporation, Melbourne, Fla.

[21] Appl. No.: 742,474

[22] Filed: Nov. 1, 1996

[51] Int. Cl.[6] ..... H01Q 1/26; H01Q 1/38

[52] U.S. Cl. ..... 343/700 MS; 343/701; 343/840; 343/786

[58] Field of Search ..... 343/700 MS, 701, 343/840, 872, 786, 909, 753; H01Q 1/26, 1/38

[56] References Cited

U.S. PATENT DOCUMENTS

| | | | |
|---|---|---|---|
| 4,914,449 | 4/1990 | Fukuzawa et al. | 343/700 MS |
| 5,043,739 | 8/1991 | Logan et al. | 343/701 |
| 5,214,394 | 5/1993 | Wong | 343/700 MS |
| 5,497,164 | 3/1996 | Croq | 343/700 MS |

*Primary Examiner*—Hoanganh T. Le
*Attorney, Agent, or Firm*—Charles E. Wands

[57] ABSTRACT

A flat panel-configured electronically steered phased array antenna includes a planar distribution of densely nested microstrip dipole sub-arrays, arranged and controlled in a manner similar to microstrip 'reflect-array' antenna elements. The resultant phase of a circularly polarized wave for a reflect-array fan-out distribution of dipole antenna elements is controlled by an associated plurality of triode-configured field emission devices. Each dipole element sub-array is plated to a resistive sub-layer on an interior surface of a flat first millimeter wave transmissive panel member of an evacuated flat panel type support structure. Mounted to a similar resistive layer on the interior surface of a second, flat panel member is a microstrip conductive layer partially overlapped around its periphery by respective fan-configured microstrip dipole antenna elements plated on the first panel member. Arranged between overlapping regions and overlapping portions of the respective dipole antenna elements are a plurality of elements, that form cathode and control gates of plural triode-configured field emission devices, the anodes of which are dipoles formed on the first plate member. These elements select a desired dipole pair within each subarray and control the current therein.

36 Claims, 7 Drawing Sheets

FLAT PANEL-CONFIGURED ELECTRONICALLY STEERABLE PHASED ARRAY ANTENNA HAVING SPATIALLY DISTRIBUTED ARRAY OF FANNED DIPOLE SUB-ARRAYS CONTROLLED BY TRIODE-CONFIGURED FIELD EMISSION CONTROL DEVICES

FIELD OF THE INVENTION

The present invention relates in general to a spatially compact antenna having an electronically steerable beam pattern, and is particularly directed to a new and improved electronically steerable phased array antenna architecture formed of a plurality of spatially distributed dipole sub-arrays and an associated arrangement of electronically controlled triode-configured field emission device control elements, that are integrated within a beam-transparent, hermetically sealed, generally flat panel structure.

BACKGROUND OF THE INVENTION

As a result of continued refinements in circuit design and miniaturization and packaging technologies, including reduced line width semiconductor processing methodologies, it has now become possible to produce monolithic miniaturized packaging schemes that are capable of housing substantially all of the components of which an RF communication system may be configured. At very high operational frequencies (e.g. on the order of 60–90 GHz or more), however, the extremely small geometries of the antenna elements and the spatial density in which such miniaturized elements are packed together do not readily lend themselves to ease of assembly with the associated beam steering (phase shifting) control circuitry and signal coupling lines that are required to implement an overall phased array antenna system design, particularly one that must be hermetically sealed.

As a consequence, separate support structures are conventionally employed for the antenna elements and their associated signal processing circuitry, yielding an overall antenna assembly architecture that is bulky and therefore not necessarily optimized for use with compact communication and avionics equipment, such as that intended for use with high performance (standoff) ordinance delivery platforms.

SUMMARY OF THE INVENTION

In accordance with the present invention, the shortcomings of conventional packaging/support structures for miniaturized electronically steerable phased array antenna systems are obviated by a new and improved architecture, which enables both the antenna elements of the spatially distributed phased array and their signal processing circuitry components to be integrated in a compact, hermetically sealed, protective/support structure, that is capable of meeting the mounting needs of advanced technology airborne platform designs and readily lending itself to applications where high density, high reliability and low cost are required. For high reliability applications, all interconnections between antenna elements and control circuits are on a single, solid (monolithic) substrate, and within the same hermetically sealed miniature assembly. (The control circuits are located in a separately sealed enclosure outside the assembly.)

As will be described, the dipole array is comprised of a generally planar distribution of spatially distributed, densely nested microstrip dipole sub-arrays, that are arranged and controlled in a manner that is similar to what are referred to as microstrip 'reflect-array' antenna elements, in which the resultant phase of a circularly polarized wave interacting with a reflect-array fan-out distribution of dipoles or spiral antenna elements is controlled by selectively shorting a distribution of switches inserted between radial locations of each dipole element and a ground plane conductor.

Each dipole sub-array comprises a plurality of fan blade-shaped microstrip dipole antenna elements equally spaced apart from one another and extending radially outwardly from a sub-array center point, so as to form equally spaced apart pairs of diametrically opposed dipole elements. By center controlling each dipole sub-array and controllably coupling the feed point to a selected diametrically opposed pair of dipole elements, the phase of the beam pattern for that respective sub-array can be controlled. Spatially distributing a plurality of these dipole element sub-arrays over a given antenna surface enables the direction of the resultant beam pattern of the overall array to be precisely defined by controlling the time-phase of the respective sub-arrays.

A respective dipole element sub-array is plated to a resistive sub-layer on the interior surface of a generally flat first millimeter wave transmissive panel member of an evacuated flat panel type support structure. Mounted to a similar resistive layer on the interior surface of a second, generally flat panel member is a microstrip conductive layer that is partially overlapped around its periphery by projections of respective ones of the fan-configured microstrip dipole antenna elements plated on the first panel member. Arranged between regions of these projection-overlapping regions and the overlapping portions of the respective dipole antenna elements are a plurality of control elements, that form respective cathode and control gates of a plurality of triode-configured field emission devices, the anodes of which are the dipole elements formed on the first plate member.

Each triode-configured field emission device has a conically shaped electron-emitting cathode element and a generally disc-shaped gate element, mounted to the cathode layer on the second panel member, the gate element having a central iris that surrounds the apex portion of the conically shaped electron-emitting cathode element and serves to control the electron beam emitted by the cathode element and collected by the anode dipole element. An array of these triodes serves to select and control the magnitude of current flow between each diametrically opposed pair of dipole elements and the cathode conductor.

The flat panel-configured architecture for the triode-configured field emission device-controlled phased array comprises a first generally flat panel 'window' plate member and a second generally flat panel 'circuitry' plate member spaced apart from the first plate member by an intermediate spacer support member, providing support in the otherwise unused space between dipole element sub-arrays as well as providing a thin evacuated space between the interior faces of the plate members in which the triode-configured field emission devices are located. In a 'reflect-array' embodiment of the antenna, wherein incoming radiation is incident upon the external surface of the first plate member, the first plate member may have a thickness corresponding to an integral number of half-wavelengths of the antenna's operational frequency band (corresponding to an overall effective electrical length of an electrically connected pair of dipole elements of a respective sub-array).

The first plate member may comprise a low millimeter wave loss dielectric material, such as quartz glass, that is capable of being ground to a precise thickness corresponding to an integral number of one-half the wavelength of the sub-array dipole resonance frequency, so as to be effectively transparent to incoming electro-magnetic waves in the millimeter band of interest. The exterior surface of the first quartz plate member may be coated with one or more auxiliary transformer layers, such as metal or dielectric layers, to improve transmission over a wide bandwidth, and may include polarizer and frequency filter layers.

The second plate member may comprise quartz glass and have a thickness corresponding to an integral number N times one-quarter the wavelength of the sub-array dipole resonance frequency, so that the second plate member serves as a half-wavelength reflector of waves incident upon the front surface of the first plate and travelling therethrough to be incident upon the second plate. The external surface of the second plate may also be coated with a thin metal layer, the electrical position of which may be tailored to function as the ground plane by properly adjusting the thickness of the second plate. In an alternative 'through the lens' transmission embodiment, the thickness of the second plate member corresponds to an integral number of one-half the wavelength of the dipole resonant frequency, and the external surface of the second plate member may be coated with a transformer dielectric layer.

The thin resistive film formed on the interior surface of the first plate member is connected to a suitable +DC power supply and serves as a current source sub-layer for the triode-configured field emission devices, the anodes for which correspond to the radial dipole elements. Plated directly onto this resistive sub-layer are the fan-configured microstrip 'anode' dipole antenna elements of each respective dipole element sub-array.

The thin resistive 'current sink' film formed on the interior surface of the second plate member is connected to a suitable −DC power supply and serves as a sub-layer for the cathode layers of the respective triode-configured field emission devices, whose anodes are the radial dipole elements. Plated directly onto this resistive film are the generally circular shaped cathode conductive layers, with diametrically opposed peripheral edge portions overlapping, in projection, radially interior portions of the 'anode' dipole elements of respective triode-configured field emission devices.

Disposed on peripheral regions of the cathode layers are conically shaped electron-emitting cathode elements of the triode-configured field emission devices. Generally disc-shaped triode control electrodes are supported by a dielectric layer adjacent to, and concentric with, apex portions of the cathode elements. The triode control electrodes are coupled via resistive traces to external control circuitry, distributed at peripheral regions of the flat panel structure.

The resistive traces and the resistive films on the interior faces of the plates have sufficiently low electrical resistance to allow DC current to be supplied to a turned-on field emission device, but sufficiently high to provide low attenuation to millimeter waves incident upon the antenna. The control grid elements control the electron beam emitted by the cathode elements and collected by the anode dipole elements, thereby controlling the current flow path between diametrically opposed pair of dipole elements and the cathode conductor and thereby which of diametrically opposed anode dipole pairs of the sub-arrays are selected.

When the flat panel-configured phased array antenna structure is to be used in a 'reflection' lens architecture, it may be affixed to a mounting ring structure backed by a rear cover panel. A section of waveguide may be employed to position a waveguide feed horn in front of the front panel of the phased array antenna, while a transceiver module may be mounted to a second end of the waveguide, such that the transceiver module is positioned directly adjacent to the rear cover panel. When it is to be used in a 'transmission' lens architecture, the flat panel antenna architecture may be affixed to a front surface of a mounting ring structure, with a feed horn mounted to a rear surface of the mounting ring structure, so that it faces the rear side of the second panel member. In each embodiment, the external control circuits are mounted to peripheral regions of the flat panel structure.

As a non-limiting example, the compact antenna architecture of the present invention may be installed in a generally cylindrically configured ordinance delivery platform, such as a high speed anti-radiation missile (HARM), with the 'transmission' lens antenna structure externally threaded into a receiving bore of a front end of a missile body to which a radome nose cover is mounted. A transceiver unit may be mounted directly behind the circular feed horn so as to provide a compact, nested structure for missile guidance control.

DETAILED DESCRIPTION

As pointed out briefly above, the electronically steered phased array antenna architecture of the present invention successfully integrates a highly packed spatial array distribution of microstrip dipole sub-arrays and an associated arrangement of electronically controlled triode-configured, field emission devices into a compact beam-transparent, hermetically sealed, generally flat panel structure. The use of triode-configured field emission devices, as opposed to diodes, not only provides on-off switch control, but also allows the magnitude of the current to be controlled, and thereby enables the invention to be incorporated into a variety of applications, where reduced size and signal control are important.

Figure 1:
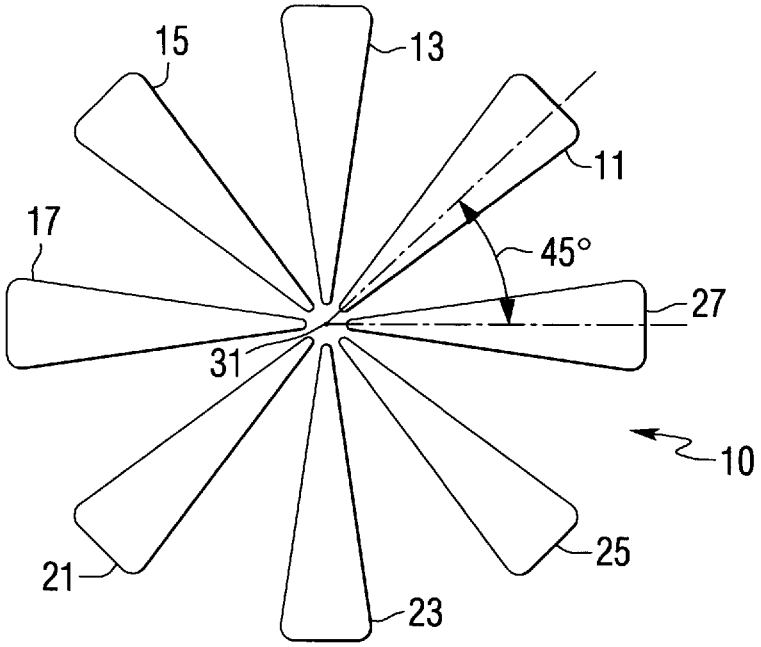
FIG. 1 diagrammatically illustrates a non-limiting example of the configuration of respective microstrip dipole sub-array that may be employed in the phased array antenna architecture in accordance with the present invention.

FIG. 1 diagrammatically illustrates a non-limiting example of the configuration of respective microstrip dipole sub-array 10 that may be employed in the phased array antenna architecture in accordance with the present invention. The microstrip dipoles of the sub-array 10 are arranged and controlled in a manner that is generally similar to those referred to as microstrip reflect-array antenna elements, as described, for example, in a presentation paper by James P. Montgomery, entitled: "A Microstrip Reflectarray Antenna Element," at the 1978 Antenna Applications Symposium, Sep. 20–22, 1978, pp 1–16, University of Illinois.

As described in that presentation paper, the resultant phase of a circularly polarized wave interacting with a reflect-array fan-out distribution of dipoles or 'spiraphase' antenna elements may be controlled by selectively turning on or shorting a distribution of shorting switches (diodes) that are inserted between prescribed radial locations of each dipole and a ground plane conductor.

Similar to the dipole configuration detailed in the Montgomery paper, the sub-array 10 of FIG. 1 is diagrammatically shown as comprising a plurality (eight in the illustrated embodiment) of radially directed or fan blade-shaped microstrip dipole antenna elements 11, 13, 15, 17, 21, 23, 25 and 27, that are generally equally spaced apart from one another and extend radially outwardly from a sub-array center point 31. In the illustrated eight dipole element sub-array, each radially extending dipole element is spaced apart from its neighboring elements by 45° thereby forming four equally spaced apart pairs of diametrically opposed dipole elements 11–21, 13–23, 15–25 and 17–27.

Figure 2:
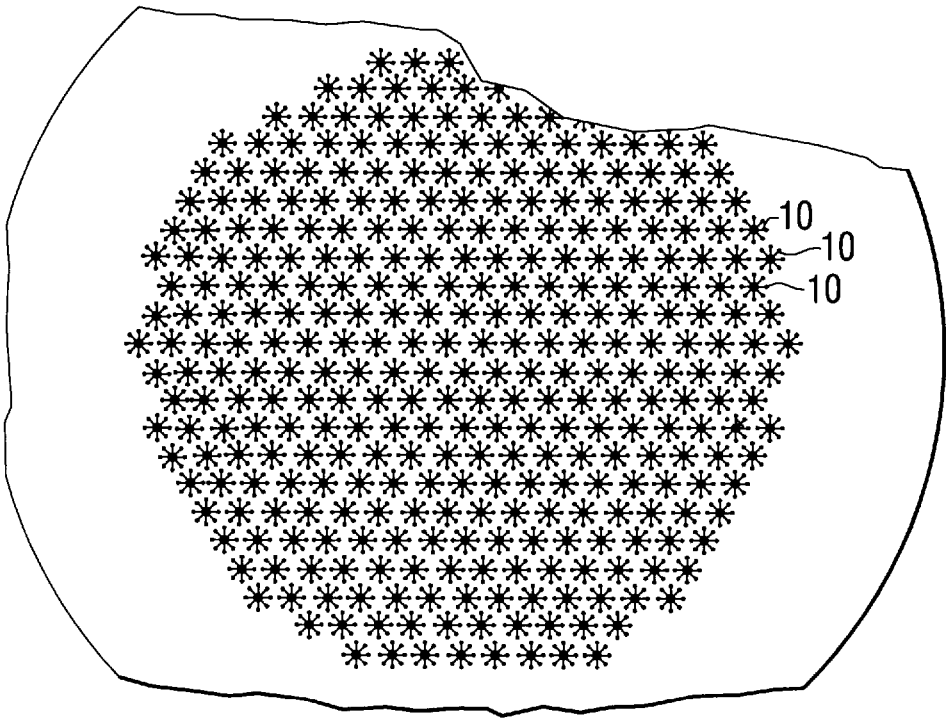
FIG. 2 diagrammatically illustrates a plurality of dipole element sub-arrays spatially distributed over an antenna surface.

As described in the Montgomery paper, by center feeding each dipole sub-array and controllably coupling the feed point to a selected diametrically opposed pair of dipole elements, the radiation pattern phase for that respective sub-array can be controlled. When a plurality of such dipole element sub-arrays are spatially distributed over a given antenna surface, as diagrammatically illustrated in FIG. 2, for example, the resultant beam pattern and/or beam direction of the overall array can be precisely tailored by controlling the radiation phases of the respective sub-arrays.

Figure 3:
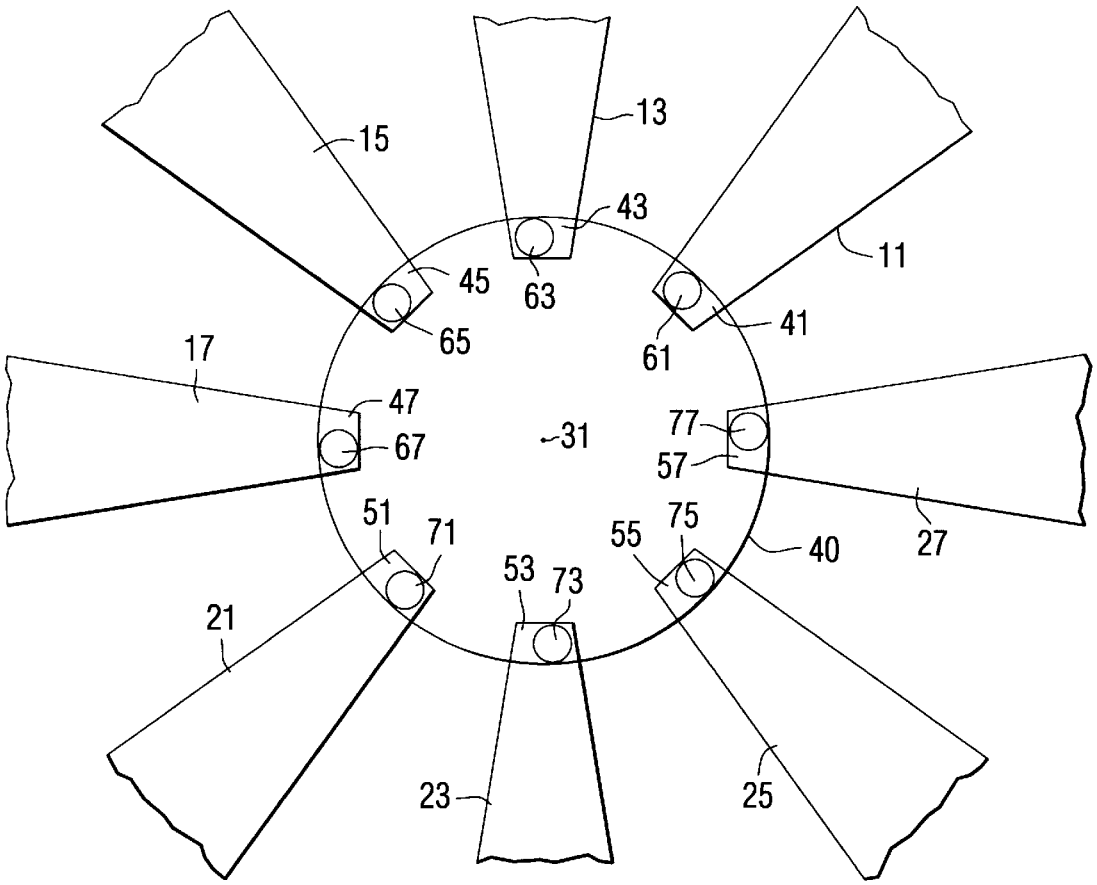
FIGS. 3 and 4 are diagrammatic top and side views of a dipole element sub-array.
Figure 4:
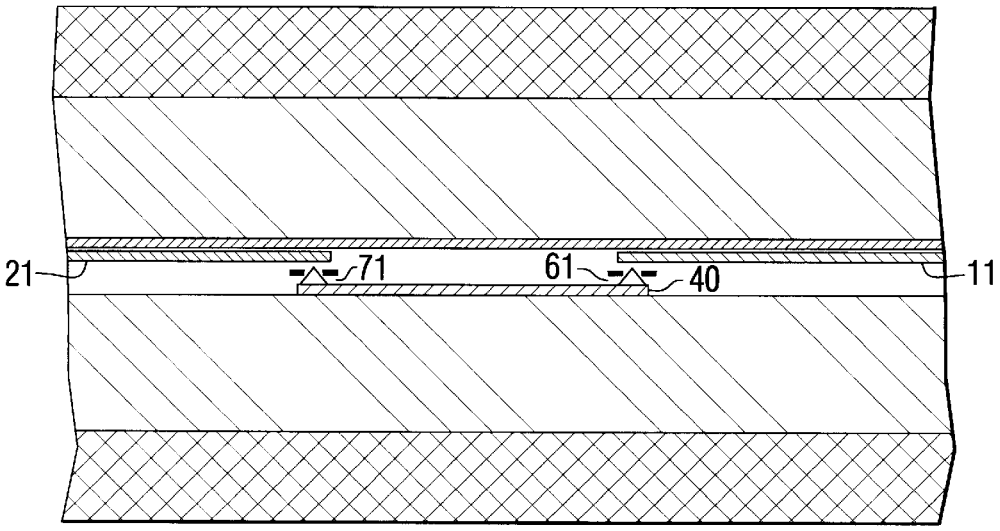

For this purpose, as diagrammatically illustrated in the top view of FIG. 3 and the side view of FIG. 4, each sub-array 10 further includes a microstrip conductive layer 40 mounted on a resistive film atop the underlying substrate. The conductive layer 40 is spaced apart from, but is partially overlapped, in projection, at regions 41, 43, 45, 47, 51, 53, 55 and 57 around its periphery by respective ones of the fan-configured microstrip dipole antenna elements 11, 13, 15, 17, 21, 23, 25 and 27.

It should be noted that the architecture of the present invention employs a plurality of the conically shaped cathode/gate structures per antenna element, operated in parallel. This allows the structure to distribute the cathode current over many devices and thereby avoid the problem of electron erosion at the tip or apex of a respective cathode. In order to avoid cluttering the drawings, the illustration in FIG. 4 (and that in FIG. 6, to be described) shows only one cathode-gate per array location.

Arranged between regions 41, 43, 45, 47, 51, 53, 55 and 57 of conductive layer 40 and the overlapping portions of respective dipole antenna elements 11, 13, 15, 17, 21, 23, 25 and 27 are a plurality of control devices 61, 63, 65, 67, 71, 73, 75 and 77. However, unlike the use of shorting diodes in the microstrip reflect-array antenna described by Montgomery, the control devices 61, 63, 65, 67, 71, 73, 75 and 77 are arrays of triode-configured field emission devices, which may be of the vacuum tube type triode devices proposed for use in flat panel display devices, as described, for example, in an article by Katherine Derbyshire, entitled: "Beyond AMLCDs: Field emission displays?" in Solid State Technology, November 1994, pp 55–65.

Figure 5:
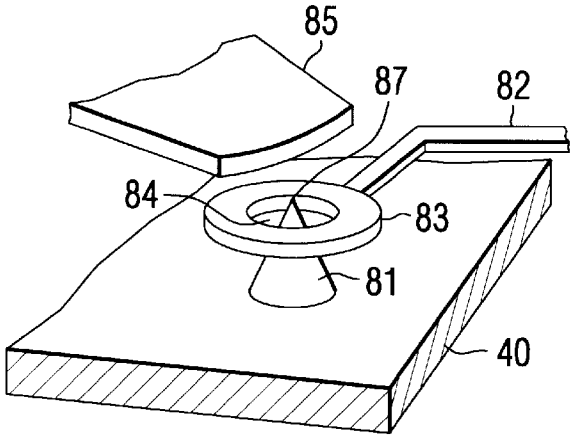
FIG. 5 diagrammatically illustrates the structure of a triode-configured field emission device.

For a respective triode-configured field emission device, its cathode, gate and anode respectively correspond to the cathode, grid and anode of a vacuum tube triode. As shown in greater detail in FIG. 5, each triode-configured field emission device has a conically shaped electron-emitting cathode element 81 mounted to the conductive layer 40, a generally washer-shaped gate or control electrode 83 (connected to a control line 82), and an anode—corresponding to a respective radially extending dipole element 85. The gate or control electrode 83 has a central aperture or iris 84 that is concentric with and surrounds the tip or apex portion 87 of the conically shaped electron-emitting cathode element 81 and, by virtue of the voltage applied thereto, serves to control the electron beam emitted by the cathode element 81 and collected by the anode dipole element 85, thereby controlling the current flow path between diametrically opposed pair of dipole elements and the cathode conductor 40, and thereby which of diametrically opposed dipole pairs of the sub-arrays are selected. In addition, the triode-configuration of the field emission device allows the magnitude of the current flowing in each sub-array to be controlled, thereby permitting greater detail in the antenna pattern, amplitude modulation of the beam, etc., providing the system with advanced detection features, countermeasure features, and communication capabilities.

Figure 6:
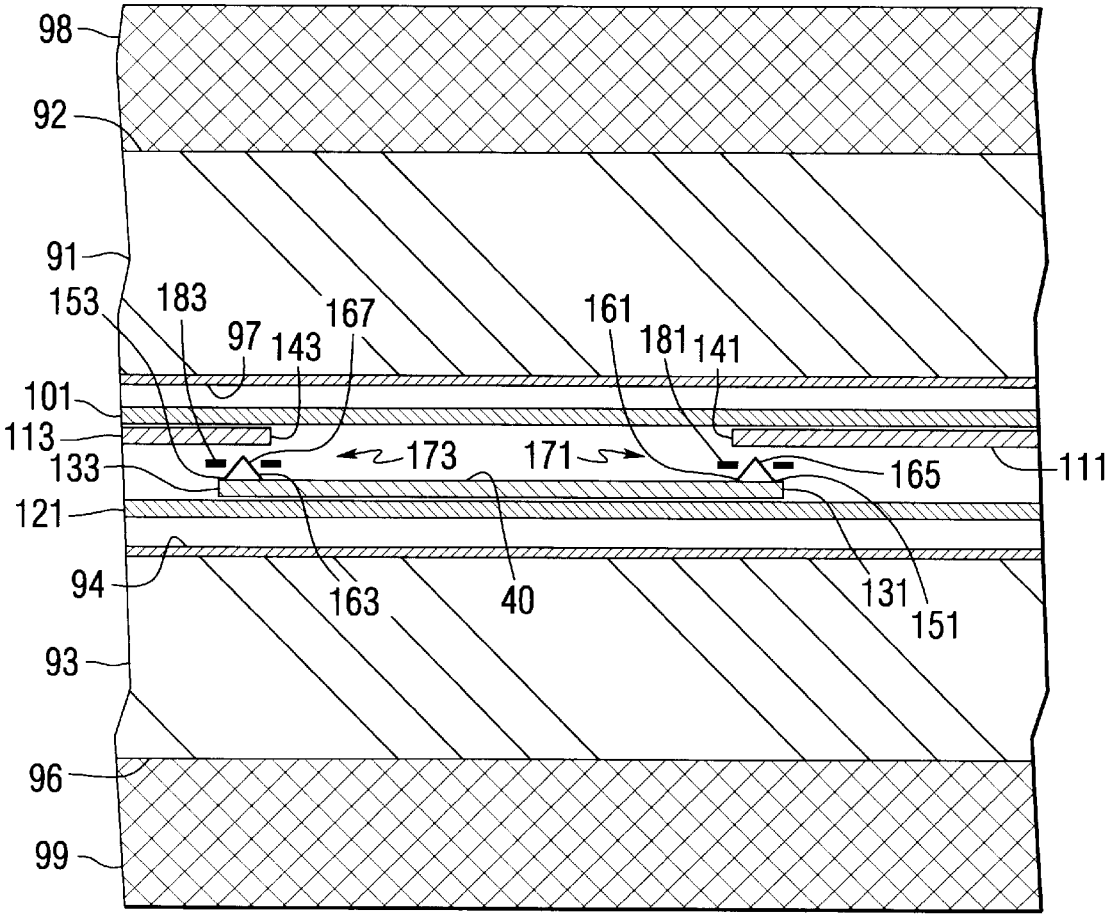
FIG. 6 diagrammatically illustrates the general architecture of the evacuated flat panel-configured, hermetically sealed antenna support structure of the present invention.

To provide both a vacuum for the field emission devices to operate, and a compact support structure for the antenna, a hermetically sealed, evacuated flat panel structure, shown in the diagrammatic side view in FIG. 6, which, like the flat panel display devices of the above-referenced Derbyshire article, provides a relative 'thin' compact structure, may be employed.

Figure 6A:
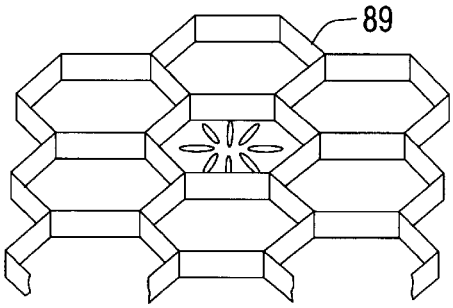
FIG. 6A diametrically illustrates a 'honeycomb' array of spacer elements.
Figure 7:
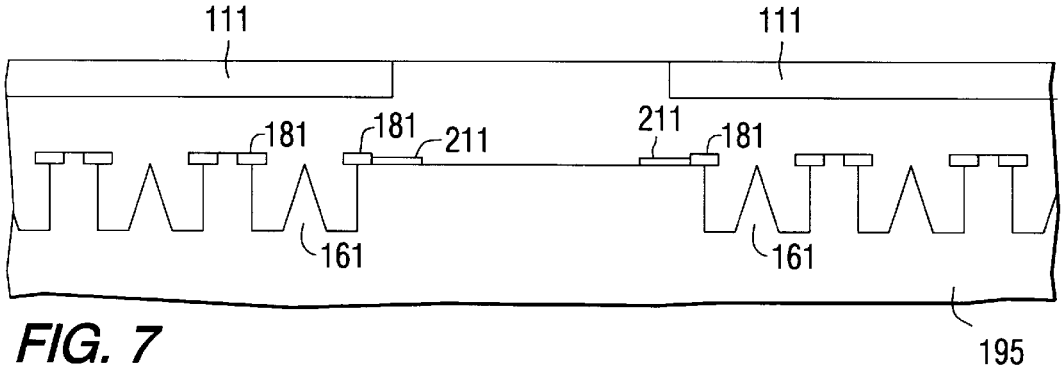
FIG. 7 shows the manner in which triode control electrodes are formed on a layer of patterned dielectric material having apertures to accommodate the conically shaped electron-emitting cathode element.

More particularly, the evacuated flat panel-configured, hermetically sealed antenna support structure of FIG. 6 comprises a first generally flat panel 'window' plate member 91 and a second generally flat panel plate member 93, spaced apart from plate member 91 by spacer elements interposed (e.g., geometrically distributed) in the sealed, evacuated space between the plate members to prevent atmospheric pressure from distorting the structure. As a non-limiting example, such spacers may be a single 'honeycomb' configuration, as diametrically illustrated at 89 in FIG. 6A. The dimensions are such that a respective dipole sub-array fits within a respective honeycomb cavity. Such spacers may be formed by means of the same photolithographic etching process used to form other panel components—the gate or control electrodes that are located adjacent to and concentric with apex portions of cathode elements of the triode-configured architecture, as will be described.

In a reflect-array embodiment, wherein incoming radiation is incident upon the external surface 92 of the first generally flat panel 'window' plate member 91, plate member 91 may be comprised of a material and may have a thickness that is generally transparent to the millimeter wave frequency band.

For this purpose, as a non-limiting example, plate member 91 may comprise a low millimeter wave loss dielectric material, such as quartz glass or ceramic material, that can be ground to a precise thickness corresponding to an integral number N times one-half the wavelength of the sub-array dipole resonance frequency, so as to be effectively transparent to electromagnetic waves in the millimeter band of interest. Namely, the ability to control the thickness of the first 'window' plate member 91 allows quartz plate 91 to operate as a dielectric impedance transformer between the impedance of free space and the impedance of the dipole element antenna array distributed on the interior surface of the quartz window plate, as will be described. Depending upon the mode of use (reflect-array or lens), such a transforming thickness may be as short as a quarter wavelength or some odd multiple of a quarter wavelength at the operating frequency of the phased array.

The exterior surface 92 of quartz window plate member 91 may also be coated with one or more auxiliary layers, shown diagrammatically in FIG. 6 as a low dielectric constant quarter wavelength transformer layer 98, such as metal or dielectric layers to improve transmission over a wide bandwidth, and may comprise polarizer and frequency filter layers. These auxiliary dielectric layers may typically be on the order of one-quarter wavelength in thickness. In addition, such coatings may include light, heat and other out-of-band interference rejection filter layers.

Similarly, the second plate member 93 may comprise a like dielectric material, such as quartz glass or ceramic material, and having a thickness corresponding to an integral number N times one-quarter the wavelength of the sub-array dipole resonance frequency, so that plate member 93 serves as a half-wavelength reflector of waves incident upon the front or exterior surface 92 of plate 91 and travelling through plate 91 to be incident upon the interior surface 94 of plate 93. Travelling through plate member 93, such waves reflect from its exterior face 96 and return toward plate 91.

Namely, the exterior face 96 of plate 93 may also be ground to a plate thickness that causes high reflection in the operating frequency band. Such a 'tuned dielectric' reflective surface can be employed as the ground plane in a reflect-array configuration. The external surface 96 of plate 93 may also be coated with metal coating 99. The electrical position of such a reflective metal coating 99 may be tailored to function as the ground plane by properly adjusting the thickness of the second plate 93. (In an alternative 'through the lens' embodiment to be described below with reference to FIGS. 12–14, the thickness of plate member 93, like plate 91, corresponds to an integral number of one-half the wavelength of the dipole resonant frequency, and the external surface of plate 93 may be coated with a transformer dielectric layer 99.)

A first thin resistive film 101, such as nichrome, having a resistivity on the order of 2000 ohms per square, is formed on the interior surface 97 of the first plate member 91 (e.g. by non-selective deposition or sputtering), and serves as a current source sub-layer for the triode-configured field emission devices, the anodes for which correspond to the radial dipole elements of the sub-array 10. For this purpose, resistive sub-layer 101 is connected to a suitable +DC power supply. It should be noted that the illustrated spacing between anode resistive film 101 and interior face 97 of plate 91 is to more clearly show the film 101, and does not exist in practice, as resistive film 101 is deposited directly on interior surface 97 of plate 91.

Plated directly onto sub-layer 101 are fan-configured microstrip 'anode' dipole antenna elements 111 of each respective dipole element sub-array 10. (The anode dipole antenna elements 111 of each respective sub-array 10 may be formed by first plating a conductive 'current source' layer (e.g. copper, silver, gold and the like) directly upon the anode resistive film sub-layer 101, followed by a mask and etch step, leaving the dipole element sub-array distribution shown in FIGS. 1 and 2.) In the diagrammatic illustration of FIG. 6, the dipole antenna elements 111 correspond to any pair of diametrically opposed ones of the antenna dipole elements 11, 13, 15, 17, 21, 23, 25 and 27 of a respective sub-array 10 shown in FIG. 1. Again, the illustrated spacing between film dipole antenna elements 111 and resistive layer 101 is to more clearly show the dipole elements.

Also shown in FIG. 6 is a second thin resistive 'current sink' film 121, which may be non-selectively formed on the interior surface 94 of the second plate member 93. Like resistive film 101, film 121 may be a nichrome film layer. Film 121 serves as a sub-layer for the cathode layers 40 of the respective triode-configured field emission devices, whose anodes are the radial dipole elements of the sub-array 10. For this purpose, resistive sub-layer 121 is connected to a suitable −DC power supply. As in the case of the conductive laminate structure on the interior face 97 of plate 91, the illustrated spacing between film 121 and interior face 94 of plate 93 is to more clearly show the resistive cathode film 121, and does not exist in practice, as film 121 is deposited directly on interior face 94 of plate 93.

Plated directly onto resistive film 121 is the generally circular shaped cathode conductive layer 40, with diametrically opposed peripheral edge portions 131 and 133 overlapping, in projection, radially interior portions 141 and 143 of 'anode' dipole elements 111 of respective field emission devices 171 and 173. Disposed on regions 151 and 153 of cathode layer 40, adjacent to peripheral edge portions 131 and 133, respectively, are conically shaped cathode elements 161 and 163 of the triode-configured field emission devices 171 and 173, respectively.

The conically shaped cathodes are made to be concentric with generally washer-shaped gates 181, 183 by a processing sequence of etching, depositing, and plating of all parts on one film substrate. The cathodes 161, 163 are formed at the same time, as the control gate electrodes 181, 183 using a single set of masks. This assures that the control electrodes 181, 183 be located adjacent to and concentric with apex portions 165 and 167 of the cathode elements 161, 163, respectively.

To provide electrical access to the various elements, the washer-shaped control electrodes 181, which surround the tips of the conically shaped cathode elements, are coupled via resistive traces 211 to external control circuitry. Each cathode for a respective dipole is electrically connected in common with all of the other cathodes for that dipole; similarly, each gate for a respective dipole is electrically connected in common with all of the other gates for that dipole. However, the connections to the cathodes and gates for each dipole are electrically separate from the connections to the cathodes and gates of other dipoles in the same antenna element array, so that each dipole is individually controllable.

Figure 8:
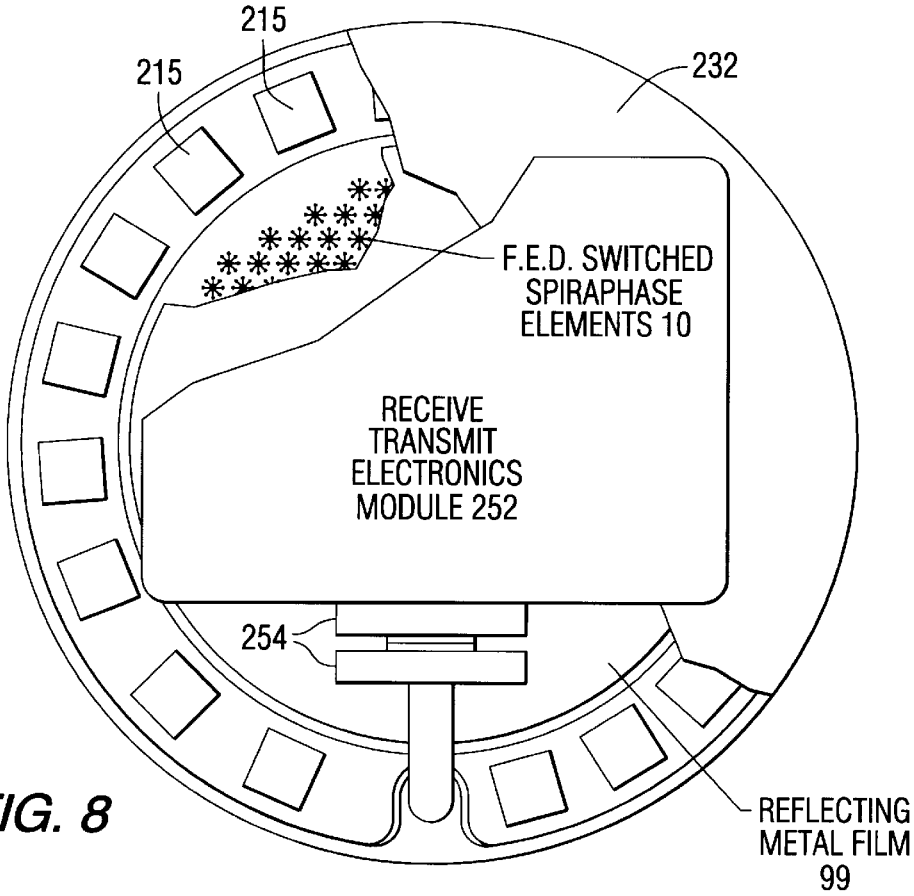
FIGS. 8 and 9 are respective rear and side sectional views of a reflection lens architecture employing the phased array antenna structure of FIG. 6.
Figure 9:
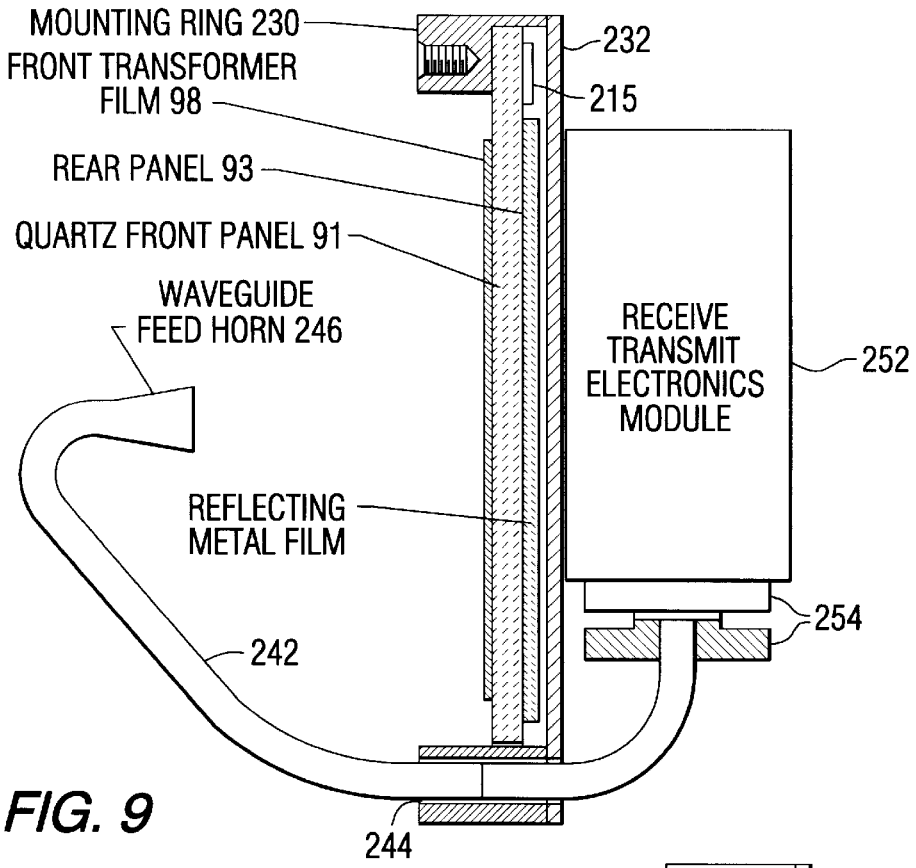

The control circuitry for the gates of the triode-configured field emission devices is diagrammatically shown at 215 in FIGS. 8 and 9 as being distributed at peripheral regions 216 of the surface 97 of front panel 91, FIGS. 8 and 9 being respective rear and side sectional views of a reflection lens architecture employing the phased array antenna structure of FIG. 6. The resistive traces 211 have sufficiently low electrical resistance to allow DC current to be supplied to an "ON" field emission triode device (171/173), but sufficiently small in size to provide low attenuation to incident millimeter waves.

For this purpose the control grid traces 211 may comprise a nichrome layer having a resistance on the order of 2000 ohms per square. The underlying dielectric layer 195 serves to electrically isolate the control grid traces from the current sink resistive layer 121 and also allows for the inclusion of cross-over links in the control grid layer. As described previously, the voltage on the control grid traces control which of diametrically opposed anode dipole pairs of the sub-arrays are selected, and how much current is allowed to flow.

The hermetically sealed flat panel structure of the present invention shown in the diagrammatic side view in FIG. 6 is connected through a fluid coupling port, and a pinch-off tube, to a vacuum source, not shown, which draws a vacuum for the array of field emission devices of the phased array antenna architecture, during its manufacture. The tube is then pinched-off (sealed) for operational use.

Figure 10:
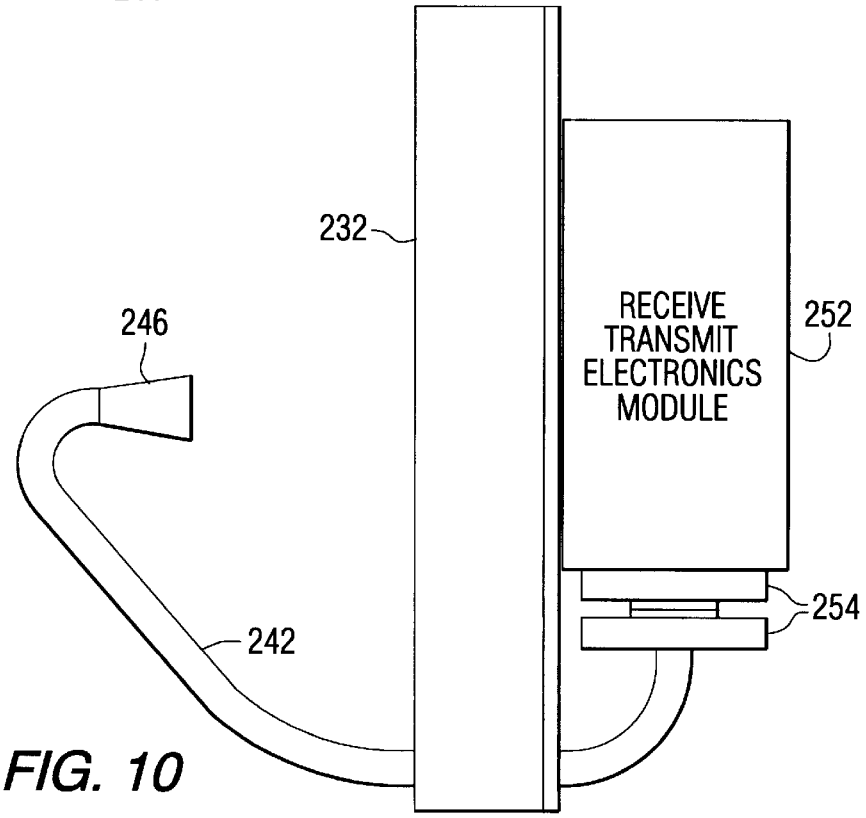
FIG. 10 shows a further side view of the reflection lens architecture of FIGS. 8 and 9, illustrating the cover enclosure.
Figure 11:
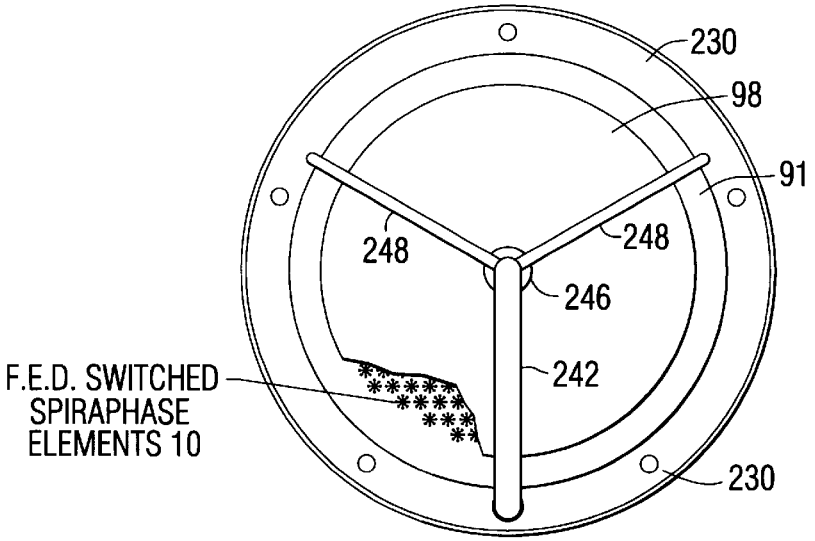
FIG. 11 is a front view of the reflection lens architecture of FIGS. 8, 9 and 10.

FIGS. 8 and 9 diagrammatically illustrate respective rear and side sectional views of an embodiment of a reflection lens architecture employing the flat panel display-configured phased array antenna structure of FIG. 6. FIG. 10 shows a further side view of the reflection lens architecture of FIGS. 8 and 9, illustrating the cover enclosure, while FIG. 11 is a front view of the reflection lens architecture. As shown therein, the evacuated flat panel structure of FIG. 6 may be affixed to a mounting ring structure 230, which is backed by a rear cover panel 232. A section of waveguide 242 passes through an aperture 244 in mounting ring structure 230 and has a waveguide feed horn 246 mounted to one end thereof facing the front panel 91 of the phased array antenna. Additional structural bracing may be provided, as shown at 248. A transceiver module 252 is mounted via waveguide flange connectors 254 to a second end of the waveguide 242, such that transceiver module 252 is positioned directly adjacent to the rear cover panel 232.

Figure 12:
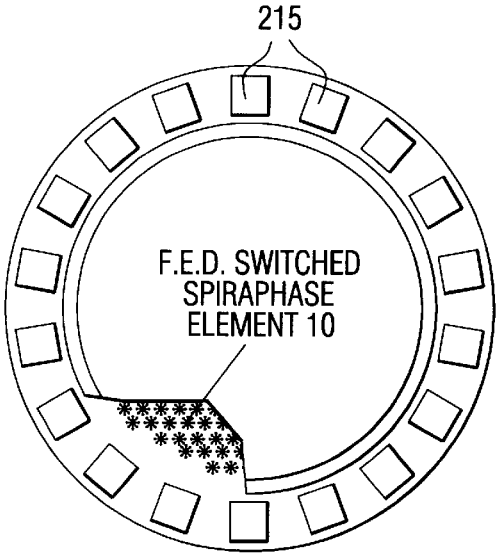
FIGS. 12 and 13 diagrammatically illustrate respective front and side sectional views of an embodiment of a transmission lens architecture employing the flat panel display-configured phased array antenna structure of FIG. 6.
Figure 13:
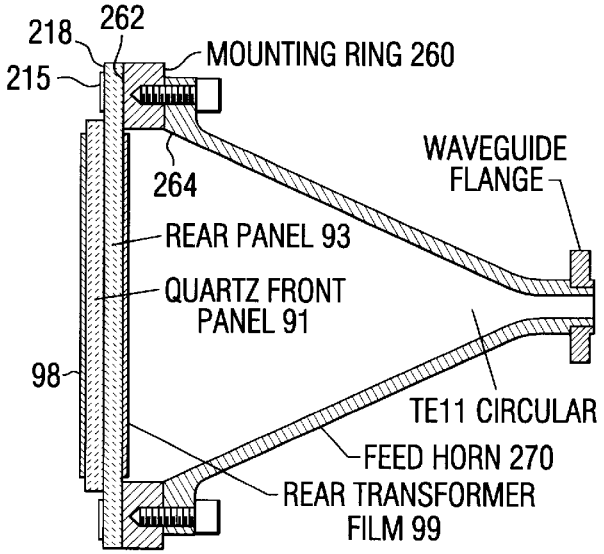
Figure 14:
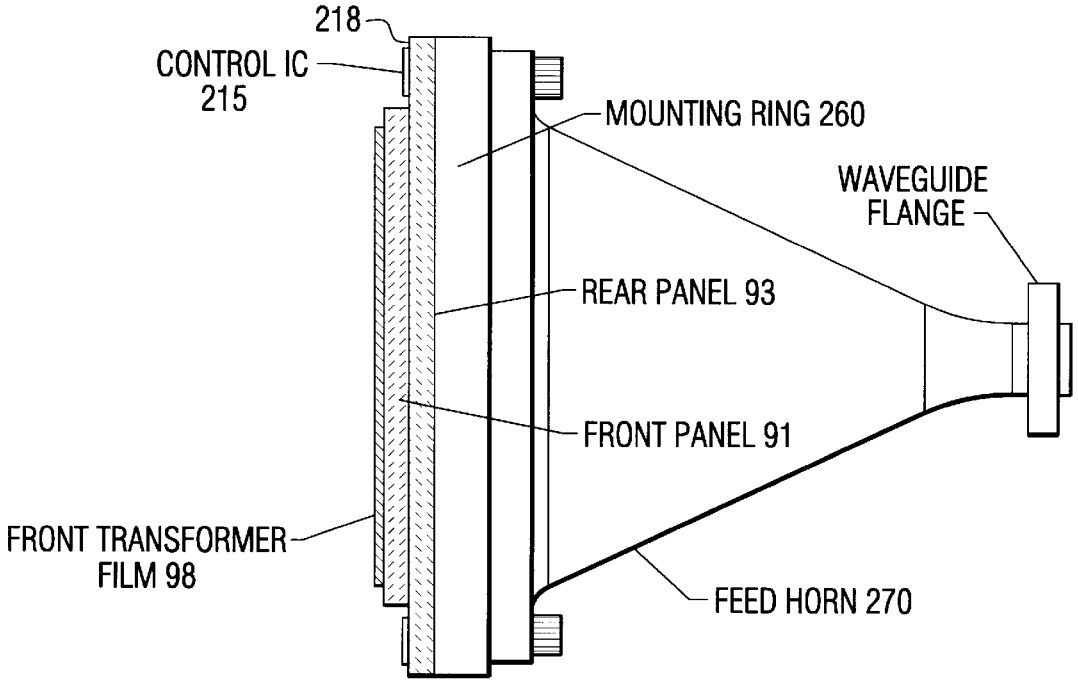
FIG. 14 shows a further side view of the transmission lens architecture of FIGS. 12 and 13, illustrating the exterior configuration of the rear enclosure for the panel provided by the mounting ring structure and feed horn.

FIGS. 12 and 13 diagrammatically illustrate respective front and side sectional views of an embodiment of a transmission lens architecture employing the flat panel display-configured phased array antenna structure of FIG. 6, while FIG. 14 shows a further side view of the transmission lens architecture of FIGS. 12 and 13, illustrating the exterior configuration of the rear enclosure for the panel provided by the mounting ring structure and feed horn. As shown therein, similar to the reflection lens embodiment of FIGS. 8–11, the evacuated flat panel structure of FIG. 6 may be affixed to a front surface 262 of a mounting ring structure 260. A circular TE11 feed horn 270 is mounted, via mounting bolts 271, to a rear surface 264 of mounting ring structure 260, so that it faces rear panel 93.

In this embodiment the external control circuits 215 are mounted to peripheral regions 218 of surface 94 of rear panel 93 facing the front panel wave 91. In addition, as pointed out above, in this transmission lens embodiment, the thickness of plate member 93, corresponds to an integral number of one-half the wavelength of the dipole resonant frequency, and the external surface of plate 93 may be coated with a transformer dielectric layer 99.

Figure 15:
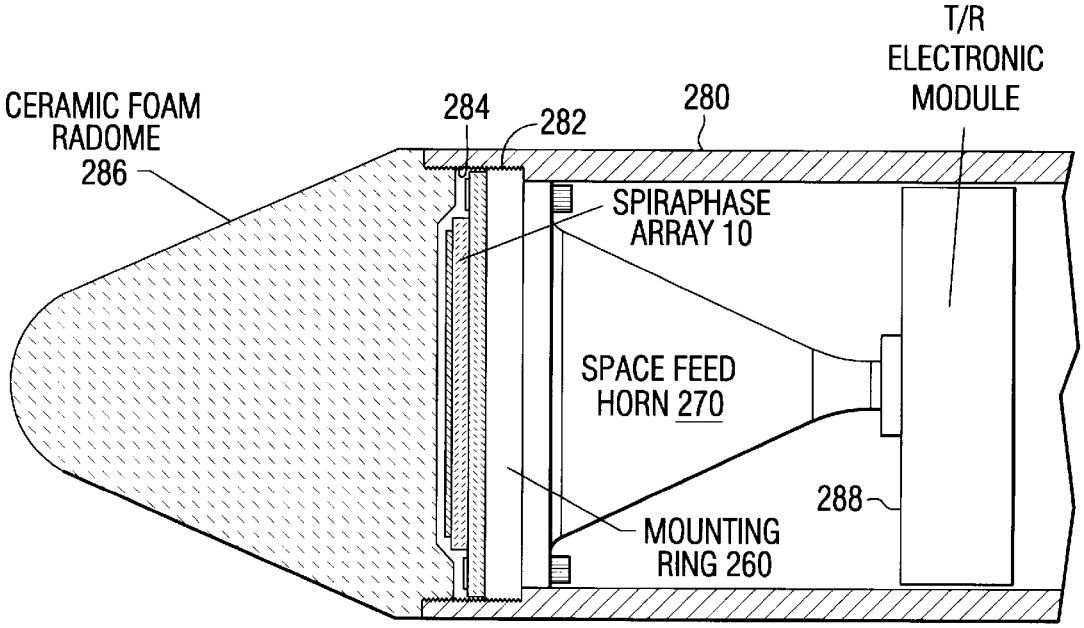
FIG. 15 diagrammatically illustrates a non-limiting example of the installation of the compact antenna architecture of the transmission lens configuration of FIGS. 13–15, in a generally cylindrically configured ordinance delivery platform, such as a high speed anti-radiation missile (HARM).

FIG. 15 diagrammatically illustrates a non-limiting example of the installation of the compact antenna architecture of the present invention, in particular, the transmission lens configuration of FIGS. 13–15, in a generally cylindrically configured ordinance delivery platform, such as a high speed anti-radiation missile (HARM) 280. As shown therein, the transmission lens antenna structure of FIGS. 13–15 may be externally threaded, as shown at 282, so that it may be threaded into a receiving bore 284 of a front end of the missile body 280, to which a radome nose cover 286 is mounted. A transceiver unit 288 is mounted directly behind the circular feed horn 270, so as to provide a compact, nested structure for missile guidance control.

As will be appreciated from the foregoing description, the shortcomings of conventional packaging/support structures for miniaturized electronically steerable phased array antenna systems are obviated by the triode-configured field emission device-controlled, flat panel-configured dipole array architecture of the present invention, which integrates a highly packed spatial array distribution of microstrip dipole sub-arrays and an associated arrangement of electronically controlled triode-configured, field emission devices into a compact beam-transparent, hermetically sealed, generally flat panel structure. The use of triode-configured field emission devices, as opposed to diodes, not only provides on-off control, but also allows the magnitude of the current to be controlled, and thereby enables the invention to be incorporated into a variety of applications, where reduced size and signal control are important.

For example, the architecture of the present invention may be employed in a military radar application, where one radar beacon is used for communication purposes, while also painting a friendly aircraft, by modulating the radar signal. By proper adjustment of the phase and amplitude of the control signals applied to the respective triode-configured field emission devices the radar antenna pattern may be precisely shaped as desired. Moreover, depending upon the design of a radar detector, it would be possible to confuse its detection circuits through amplitude modulation.

The ability to package the antenna elements and their associated control elements in a single compact assembly not only will benefit fixed-mount antenna systems (such as a HARM missile), but also movable antennas. One of the 'most movable' antennas is that located in the nose of an active radar tracking missile, for example of the Sparrow (AIM-7) type. These types of missiles have an antenna that is physically spun to provide gyroscopic stability, while the antenna is radiating and receiving energy. Once it is locked on to a target, the antenna-gyro is precessed to keep tracking the target.

As targets become more agile, it is more difficult for the more stable antennas (those being spun at a high rotational rate) to be precessed fast enough to keep up with the target and maintain lock. (The difficulty lies with the fact that precession rate is inversely proportional to angular momentum of the gyro.) For this application, a simple, rapidly responsive, phased array antenna, that is compact and rugged enough (monolithic, as described herein) to be spun as part of the gyro wheel, or, in a non-spinning configuration, mounted in front of a spinning antenna, would permit the radar system to track an agile target. The more stable, slower, mechanically gimballed portion of the antenna provides large off-axis tracking, while the agile phased-array antenna components provide fast response over a more limited angular range.

Thus, the compact, rugged nature of the triode-configured field emission device controlled phase-array assembly architecture of the present invention makes its use even more attractive in applications where the antenna must be continually redirected; in general, as an assembly becomes more monolithic, its behavior tends to be more reliable and predictable in a highly dynamic environment, such as tracking an agile target, as described above. As a consequence, a phased array antenna architecture in accordance with the present invention has applications that range from large land-based tracking antennas, to small active tracking airborne antennas, such as are employed in air-to-air missiles.

While we have shown and described several embodiments in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed:

1. A phased array antenna comprising a plurality of spatially distributed radiation elements and an arrangement of field emission devices electrically coupled with said plurality of spatially distributed radiation elements, a respective one of said field emission devices having a first electrode coupled in circuit with one of said radiation elements, a second electrode coupled in circuit with a second electrode of another of said field emission devices, said another of said field emission devices having a first electrode thereof coupled in circuit with another of said radiation elements, and wherein each of said one and another of said field emission devices has a selectively controllable current flow path therethrough between first and second electrodes thereof, so as to control electrical coupling therethrough between said one and said another of said radiation elements.

2. A phased array antenna according to claim 1, wherein selected field emission devices are electrically coupled with selected sets of said radiation elements.

3. A phased array antenna according to claim 2, wherein selected field emission devices are electrically coupled with selected pairs of said radiation elements.

4. A phased array antenna according to claim 3, wherein said plurality of spatially distributed radiation elements comprises spatially distributed sets of radiation elements, each set of radiation elements comprising a sub-array of radiation elements spatially distributed in a regular geometric pattern.

5. A phased array antenna according to claim 4, wherein radiation elements of a respective sub-array comprise dipole elements spatially distributed in a regular geometric pattern about a center conductor element, and wherein respective pairs of arrays of said field emission devices are distributed in a diametrically opposed manner around the perimeter of said center conductor element, so as to provide an electrically controlled conductive path between respective pairs of said dipole elements.

6. A phased array antenna according to claim 5, further including an evacuated hermetically sealed structure within which said plurality of spatially distributed radiation elements and said arrangement of field emission devices are supported, and wherein said hermetically sealed structure comprises a first generally flat panel member that is generally transparent to electromagnetic waves having a half-wavelength corresponding to an overall effective electrical length of an electrically connected pair of said dipole elements, and a second generally flat panel member spaced apart from and hermetically sealed with said first generally flat panel member.

7. A phased array antenna according to claim 6, wherein said radiation elements are supported upon an interior surface of said first generally flat panel member, and wherein said arrangement of field emission devices is supported upon an interior surface of said second generally flat panel member.

8. A phased array antenna according to claim 7, wherein said second generally flat panel member is generally transparent to electromagnetic waves having said wavelength.

9. A phased array antenna according to claim 7, wherein said second generally flat panel member has a thickness corresponding to an integral number times one-quarter of said wavelength.

10. A phased array antenna according to claim 1, further including a hermetically sealed structure within which said plurality of spatially distributed radiation elements and said arrangement of field emission devices are supported.

11. A phased array antenna according to claim 10, wherein said hermetically sealed structure comprises a first generally flat panel member that is generally transparent to electromagnetic waves having a wavelength associated with a resonance frequency of said radiation elements, and a second generally flat panel member spaced apart from and hermetically sealed with said first generally flat panel member.

12. A phased array antenna according to claim 10, further comprising a radiating horn element attached with said hermetically sealed structure.

13. A phased array antenna according to claim 10, further comprising antenna pattern control circuitry coupled to said plurality of spatially distributed radiation elements.

14. A phased array antenna according to claim 1, wherein each of said field emission devices comprises a field emission triode device having a control electrode coupled to receive a control input for controlling current flow between first and second electrodes of said each field emission device.

15. A phased array antenna comprising a flat panel structure including first and second plate members that are effectively transparent to radiation in a frequency band of operation of said phased array antenna, said first and second plate members being spaced apart from and hermetically sealed with one another, so as to form a thin evacuated space between interior faces of said first and second plate members, a dipole array formed on the interior face of said first plate member, said dipole array being comprised of a generally planar distribution of microstrip dipole sub-arrays, each dipole sub-array comprising a plurality of microstrip dipole antenna elements spaced apart from one another and extending radially outwardly from a sub-array feed location, so as to form spaced apart pairs of diametrically opposed dipole elements within a respective sub-array, a microstrip conductive layer formed on the interior face of said second plate member so as to be partially overlapped, in projection, around its periphery by respective ones of said dipole antenna elements formed on said first plate member, and a plurality of elements, that form respective cathode and control gates of a plurality of triode-configured field emission devices, the anodes of which correspond to dipole elements formed on the interior face of said first plate member, said devices being disposed upon said microstrip conductive layer on the interior face of said second plate member.

16. A phased array antenna according to claim 15, wherein a respective triode-configured field emission device comprises a conically shaped electron-emitting cathode element mounted to said microstrip conductive layer on said interior face of said second panel member, and a gate electrode having an iris adjacent to and concentric with an apex portion of said conically shaped electron-emitting cathode element and operative to control an electron beam emitted by said cathode element and collected by an associated anode dipole element, thereby controlling a current flow path between a diametrically opposed pair of dipole elements and said microstrip conductive layer.

17. A phased array antenna according to claim 15, wherein said first plate member comprises a low millimeter wave loss dielectric material, having a thickness corresponding to an integral number of one-half the wavelength of a sub-array dipole resonance frequency, so as to be effectively transparent to incoming electromagnetic waves in a millimeter band of operation of said antenna.

18. A phased array antenna according to claim 15, wherein an exterior surface of said first plate member is coated with one or more auxiliary transformer layers.

19. A phased array antenna according to claim 15, wherein said second plate member has a thickness corresponding to an integral number N times one-quarter the wavelength of a sub-array dipole resonance frequency, so that said second plate member is operative as a half-wavelength reflector of waves incident upon an exterior surface of the first plate and travelling therethrough to be incident upon said second plate member.

20. A phased array antenna according to claim 15, wherein an exterior surface of said second plate is coated with a thin metal layer, which functions electrically as a ground plane.

21. A phased array antenna according to claim 15, wherein said second plate member has a thickness corresponding to an integral number N times one-half the wavelength of a sub-array dipole resonance frequency, so that said second plate member is operative as a half-wavelength transmitter of waves incident upon an exterior surface thereof and travelling therethrough to be incident upon said first plate member.

22. A phased array antenna according to claim 15, wherein an exterior surface of said second plate member is coated with one or more auxiliary transformer layers.

23. A phased array antenna according to claim 15, further including a first thin resistive film formed on the interior face of said first plate member and being connected to a DC power supply of a first polarity, so as to provide a current source sub-layer for said field emission devices, anodes for which correspond to radial dipole elements of said sub-arrays mounted upon said first thin resistive film.

24. A phased array antenna according to claim 23, further including a second thin resistive film formed on the interior face of said second plate member and being connected to a DC power supply of a second polarity, so as to provide a current sink sub-layer for said field emission devices, cathodes for which correspond to said microstrip conductor mounted a peripheral portion of said second thin resistive film.

25. A phased array antenna according to claim 24, wherein a respective triode-configured field emission device comprises a conically shaped electron-emitting cathode element mounted to said microstrip conductive layer on said second thin resistive layer formed on said interior face of said second plate member, and a gate electrode having an iris adjacent to and concentric with an apex portion of said conically shaped electron-emitting cathode element and operative to control an electron beam emitted by said cathode element and collected by an associated anode dipole element on said first thin resistive layer on said first plate member, thereby controlling a current flow path between a diametrically opposed pair of dipole elements and said microstrip conductive layer, said gate electrode being formed on a dielectric layer adjacent to an apex portion of a cathode element, and a resistive trace coupling said gate electrode to an external control circuit at a peripheral region of said flat panel structure. The resistive traces have sufficiently low electrical resistance to allow DC current to be supplied to a turned-on triode-configured field emission device, but sufficiently high to provide low attenuation to millimeter waves incident upon the antenna, and wherein the voltage on the control grid traces controls the electron beam emitted by the cathode elements and collected by the anode dipole elements, thereby controlling the current flow path between diametrically opposed pair of dipole elements and the cathode conductor and which of the diametrically opposed anode dipole pairs of the sub-arrays are selected.

26. A phased array antenna according to claim 15, wherein said flat panel structure is affixed to a mounting ring structure backed by a rear cover panel, and further including a section of waveguide which extends from a waveguide feed horn supported adjacent to an exterior face of said first plate member to a transceiver module, that is mounted to a second end of said section of waveguide supported adjacent to an exterior face of said second plate member, such that the transceiver module is positioned directly adjacent to said rear cover panel, and further including beam pattern control circuits mounted around the periphery of said flat panel structure, and wherein said control gates of said plurality of triode-configured field emission devices are coupled to said beam pattern control circuits.

27. A phased array antenna according to claim 15, wherein said flat panel structure is affixed to a front surface portion of a mounting ring structure, and further including a feed horn mounted to a rear surface of said mounting ring structure, so that said feed horn faces an exterior face of said second plate member, and is arranged to be coupled to a transceiver module supported adjacent thereto, and further including beam pattern control circuits mounted around the periphery of said flat panel structure, and wherein said control gates of said plurality of triode-configured field emission devices are coupled to said beam pattern control circuits.

28. A method of electronically steering an antenna pattern comprising the steps of:

(a) providing a phased array antenna of a plurality of spatially distributed radiation reflector elements;

(b) coupling a radiating horn element to said plurality of spatially distributed reflector radiation elements; and (c) controlling the operation of selected ones of said plurality of spatially distributed radiation reflector elements by controlling conductivity through field emission devices and thereby defining and steering an antenna pattern associated with said plurality of spatially distributed radiation reflector elements, a respective one of said field emission devices having a first electrode coupled in circuit with one of said radiation reflector elements, a second electrode coupled in circuit with a second electrode of another of said field emission devices, said another of said field emission devices having a first electrode thereof coupled in circuit with another of said radiation reflector elements, and wherein each of said one and another of said field emission devices has a selectively controllable current flow path between first and second electrodes thereof, so as to control electrical coupling therethrough between said one and said another of said radiation reflector elements.

29. A method according to claim 28, wherein radiation reflector elements of a respective sub-array of said plurality of spatially distributed radiation reflector elements provided in step (a) comprise dipole elements spatially distributed in a regular geometric pattern about a center conductor element, respective pairs of arrays of said field emission devices are distributed in a diametrically opposed manner around the perimeter of said center conductor element, so as to provide an electrically controlled conductive path between respective pairs of said dipole elements.

30. A method according to claim 28, wherein each of said field emission devices comprises a field emission triode device having a control electrode coupled to receive a control input for controlling current flow between first and second electrodes thereof and step (c) comprises controlling current flow through said field emission triode devices, and thereby controlling the operation of selected ones of said plurality of spatially distributed radiation reflector elements.

31. A method according to claim 30, wherein said dipole elements and said field emission triode devices are housed in an evacuated hermetically sealed structure including generally flat plate members generally transparent to electromagnetic waves at the operating band of said antenna.

32. A method according to claim 31, wherein said dipole elements are supported upon an interior surface of a first generally flat plate member, and wherein said field emission, triode devices are supported upon an interior surface of a second generally flat plate member.

33. A phased array antenna comprising a plurality of spatially distributed radiation elements and an arrangement of triode-configured field emission devices electrically coupled with said plurality of spatially distributed radiation elements, and wherein selected arrays of said triode-configured field emission devices are electrically coupled with selected sets of said radiation elements.

34. A phased array antenna according to claim 33, wherein selected arrays of said triode-configured field emission devices are electrically coupled with selected pairs of said radiation elements.

35. A phased array antenna according to claim 34, wherein said plurality of spatially distributed radiation elements comprises spatially distributed sets of radiation elements, each set of radiation elements comprising a sub-array of radiation elements spatially distributed in a regular geometric pattern.

36. A phased array antenna according to claim 35, wherein radiation elements of a respective sub-array comprise dipole elements spatially distributed in a regular geometric pattern about a center conductor element, and wherein respective pairs of arrays of said field emission devices are distributed in a diametrically opposed manner around the perimeter of said center conductor element, so as to provide an electrically controlled conductive path between respective pairs of said dipole elements.

* * * * *